US008900411B2

(12) United States Patent
Konishi et al.

(10) Patent No.: US 8,900,411 B2
(45) Date of Patent: Dec. 2, 2014

(54) MANUFACTURING METHOD FOR NONWOVEN FABRIC

(75) Inventors: Takayoshi Konishi, Kanonji (JP); Toshio Hiraoka, Kanonji (JP); Masaki Yoshida, Kanonji (JP); Toshifumi Hikosaka, Kanonji (JP); Noritomo Kameda, Kanonji (JP)

(73) Assignee: Unicharm Corporation, Ehime (JP)

( * ) Notice: Subject to any disclaimer, the term of this patent is extended or adjusted under 35 U.S.C. 154(b) by 0 days.

(21) Appl. No.: 14/008,311

(22) PCT Filed: Feb. 3, 2012

(86) PCT No.: PCT/JP2012/052544
§ 371 (c)(1),
(2), (4) Date: Sep. 27, 2013

(87) PCT Pub. No.: WO2012/132549
PCT Pub. Date: Oct. 4, 2012

(65) Prior Publication Data

US 2014/0014284 A1 Jan. 16, 2014

(30) Foreign Application Priority Data

Mar. 28, 2011 (JP) ..... 2011-070225

(51) Int. Cl.

| | |
|---|---|
| ***D21F 11/00*** | (2006.01) |
| ***D04H 1/46*** | (2012.01) |
| ***D21H 25/00*** | (2006.01) |
| ***D21F 11/14*** | (2006.01) |

(52) U.S. Cl.
CPC ..... *D21F 11/006* (2013.01); *D21F 11/145* (2013.01); *D21F 11/008* (2013.01)
USPC ..... 162/115; 162/207; 162/208; 162/117; 28/104

(58) Field of Classification Search
CPC ..... D04H 1/465; D04H 3/102; D21F 11/145; D21F 11/006; D21F 11/008; D21H 27/002; D21H 27/005; D21H 27/02; D21H 23/24; D21H 23/44; D21H 23/48
USPC ..... 162/103, 109, 115, 117, 204, 207–208; 28/103–105
See application file for complete search history.

(56) References Cited

U.S. PATENT DOCUMENTS 3,485,706 A * 12/1969 Evans ..... 428/134
4,612,226 A * 9/1986 Kennette et al. ..... 428/134

(Continued)

FOREIGN PATENT DOCUMENTS

EP 0411752 A1 2/1991
EP 0483816 A1 5/1992

(Continued)

OTHER PUBLICATIONS

Machine Translation of JP 2009-097133, published on May 7, 2009.*

(Continued)

*Primary Examiner* — Jose Fortuna
(74) *Attorney, Agent, or Firm* — Lowe Hauptman & Ham, LLP

(57) ABSTRACT

There is provided a method for producing a nonwoven fabric that can produce a nonwoven fabric having high strength, high bulk and softness. The method for producing a nonwoven fabric according to the invention comprises a step of supplying a water-containing paper-making material onto a support to form a paper layer 21 on the support, a step of injecting a high-pressure water jet stream onto the paper layer 21 from a high-pressure water jet stream nozzle 12 provided above the support, a step of injecting high-pressure steam onto the paper layer 21 on which the high-pressure water jet stream has been injected, from a steam nozzle 14 provided above the support, and a step of drying the paper layer on which the high-pressure steam has been injected.

5 Claims, 7 Drawing Sheets

(56) References Cited

U.S. PATENT DOCUMENTS

| | | | | |
|---|---|---|---|---|
| 5,009,747 | A * | 4/1991 | Viazmensky et al. | 162/115 |
| 5,077,913 | A * | 1/1992 | Akerblom et al. | 34/85 |
| 5,137,600 | A * | 8/1992 | Barnes et al. | 162/115 |
| 5,290,628 | A * | 3/1994 | Lim et al. | 442/408 |
| 5,389,202 | A * | 2/1995 | Everhart et al. | 162/103 |
| 6,058,583 | A * | 5/2000 | Takeuchi et al. | 28/104 |
| 6,287,419 | B1 * | 9/2001 | Takeuchi et al. | 162/115 |
| 6,673,204 | B2 * | 1/2004 | Takai et al. | 162/115 |
| 6,749,718 | B2 * | 6/2004 | Takai et al. | 162/115 |
| 7,210,205 | B2 * | 5/2007 | Takeuchi et al. | 28/104 |
| 7,241,711 | B2 * | 7/2007 | Takai et al. | 442/414 |
| 7,395,588 | B2 * | 7/2008 | Taniguchi et al. | 28/104 |
| 7,549,202 | B2 * | 6/2009 | Taniguchi et al. | 28/104 |
| 7,562,425 | B2 * | 7/2009 | Taniguchi et al. | 28/104 |
| 2001/0023160 | A1 * | 9/2001 | Yamada et al. | 442/413 |
| 2002/0065011 | A1 * | 5/2002 | Takeuchi et al. | 442/336 |
| 2002/0100153 | A1 * | 8/2002 | Takai et al. | 28/104 |
| 2003/0099821 | A1 * | 5/2003 | Takai et al. | 428/292.1 |
| 2003/0100240 | A1 * | 5/2003 | Takai et al. | 442/408 |
| 2006/0042057 | A1 | 3/2006 | Taniguchi et al. | |
| 2008/0178442 | A1 * | 7/2008 | Taniguchi et al. | 28/104 |
| 2008/0179431 | A1 | 7/2008 | Taniguchi et al. | |
| 2011/0294388 | A1 * | 12/2011 | Konishi et al. | 442/414 |
| 2014/0014284 | A1 * | 1/2014 | Konishi et al. | 162/115 |

FOREIGN PATENT DOCUMENTS

| | | | | |
|---|---|---|---|---|
| EP | 1553222 | A1 | 7/2005 | |
| JP | 2000034690 | A * | 2/2000 | D21F 1/44 |
| JP | 2000273747 | A | 10/2000 | |
| JP | 200997133 | A | 5/2009 | |
| JP | 2009097133 | A | 5/2009 | |
| JP | 2009144316 | A | 7/2009 | |
| JP | 2011067989 | A * | 4/2011 | |
| JP | 2012202004 | A * | 10/2012 | |
| JP | 2012202011 | A * | 10/2012 | |
| JP | 2013076196 | A * | 4/2013 | |
| JP | 2013170328 | A * | 9/2013 | |
| JP | 2013209765 | A * | 10/2013 | |
| JP | 2013209766 | A * | 10/2013 | |
| JP | 2013209767 | A * | 10/2013 | |

OTHER PUBLICATIONS

Corresponding International Application No. PCT/JP2012/052544 Search Report dated Apr. 24, 2012.

* cited by examiner (a)

(b)

MANUFACTURING METHOD FOR NONWOVEN FABRIC

RELATED APPLICATIONS

The present application is based on and claims priority to International Application Number PCT/JP2012/052544, filed Mar. 2, 2012, and Japanese Application Number 2011-070225, filed Mar. 28, 2011, the disclosure of which is hereby incorporated by reference herein in its entirety.

TECHNICAL FIELD

The present invention relates to a method for producing a nonwoven fabric wherein a nonwoven fabric is produced from a fiber sheet containing water.

BACKGROUND ART

As prior art, there is known a method for producing a high-bulk sheet wherein a fiber suspension containing an added wet paper strength agent is supplied from a paper-making material supply head onto a paper layer-forming belt to accumulate fibers on the paper layer-forming belt, a wet fiber sheet is formed, a suction box is used for dewatering of the fiber sheet, and then steam is injected from a steam-injecting nozzle onto the fiber sheet to impart a prescribed pattern to the fiber sheet (for example, Japanese Unexamined Patent Publication No. 2000-34690). By this method for producing a high-bulk sheet, it is possible to produce a high-bulk sheet with large thickness, high absorption, excellent softness and suitable sturdiness.

DISCLOSURE OF THE INVENTION

Technical Problem

However, there is demand for nonwoven fabrics having even higher strength than nonwoven fabrics formed from fiber suspensions containing an added wet paper strength agent, as described in Japanese Unexamined Patent Publication No. 2000-34690, as well as high bulk and softness.

It is an object of the present invention to provide a nonwoven fabric with high strength, high bulk and softness.

Solution to Problem

In order to solve the aforementioned problems, the invention has the following feature.

Specifically, the method for producing a nonwoven fabric according to the invention comprises a step of supplying a water-containing paper-making material onto a support to form a paper layer on the support, a step of injecting a high-pressure water jet stream onto the paper layer from a high-pressure water jet stream nozzle provided above the support, a step of injecting high-pressure steam onto the paper layer on which the high-pressure water jet stream has been injected, from a steam nozzle provided above the support, and a step of drying the paper layer on which the high-pressure steam has been injected.

Effect of the Invention

According to the invention, it is possible to obtain a nonwoven fabric having high strength, high bulk and softness.

DESCRIPTION OF EMBODIMENTS

Figure 1:
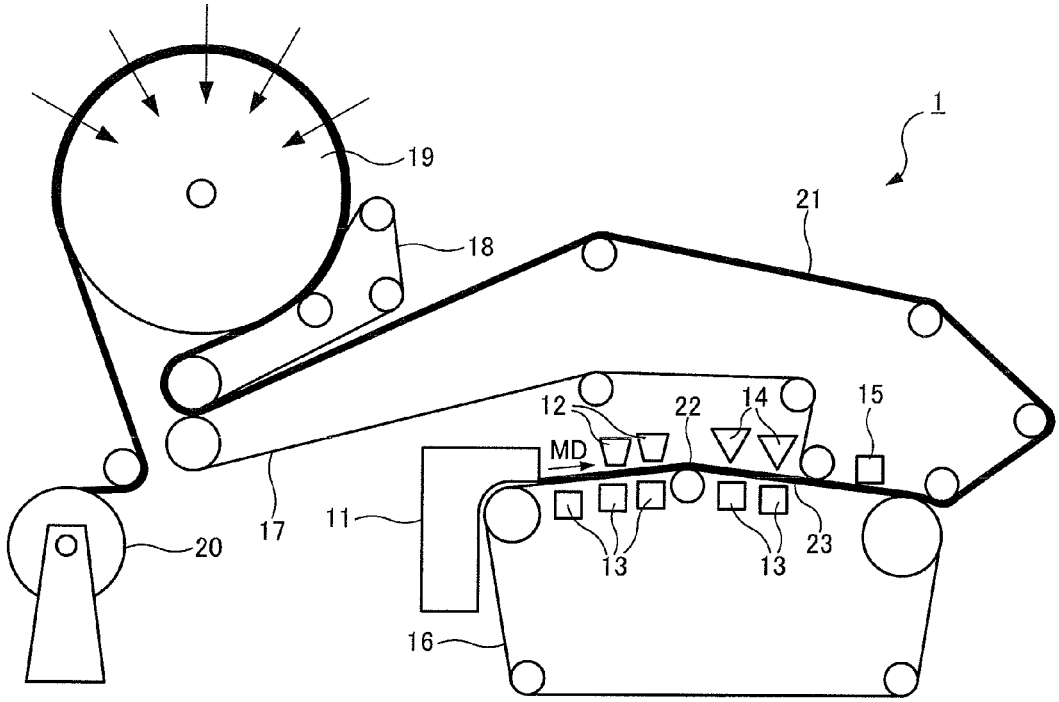
FIG. 1 is a diagram for illustration of a nonwoven fabric production apparatus to be used in a method for producing a nonwoven fabric according to an embodiment of the invention.

The method for producing a nonwoven fabric according to an embodiment of the invention will now be explained in greater detail with reference to the accompanying drawings. FIG. 1 is a diagram for illustration of a nonwoven fabric production apparatus 1 to be used in a method for producing a nonwoven fabric according to an embodiment of the invention.

First, a water-containing paper-making material such as a fiber suspension is prepared. The fibers to be used in the paper-making material are preferably short fibers with fiber lengths of not greater than 10 mm. Such short fibers may be cellulose-based fibers, for example, wood pulp such as chemical pulp, semichemical pulp or mechanical pulp from a conifer or broadleaf tree, mercerized pulp or crosslinked pulp obtained by chemical treatment of such wood pulp, or nonwood fibers such as hemp or cotton or regenerated fibers such as rayon fibers, or synthetic fibers such as polyethylene fibers, polypropylene fibers, polyester fibers or polyamide fibers. The fibers to be used in the paper-making material are preferably cellulose-based fibers such as wood pulp, nonwood pulp or rayon fibers.

The paper-making material is supplied onto the paper layer-forming belt of a paper layer-forming conveyor 16 by a starting material supply head 11, and accumulated on the paper layer-forming belt. The paper layer-forming belt is preferably an air-permeable support that is permeable to steam. For example, a wire mesh, blanket or the like may be used as the paper layer-forming belt.

The paper-making material accumulated on the paper layer-forming belt is appropriately dewatered by a suction box 13, and thereby a paper layer 21 is formed. The paper layer 21 passes between two high-pressure water jet stream nozzles 12 situated above the paper layer-forming belt, and two suction boxes 13, situated at the opposite side of the high-pressure water jet stream nozzles 12 across the paper layer-forming belt, that collect water injected from the high-pressure water jet stream nozzles 12. At this time, the paper layer 21 is injected with high-pressure water jet streams from the high-pressure water jet stream nozzles 12, and furrows are formed on the top surface (the surface on the high-pressure water jet stream nozzle 12 side).

Figure 2:
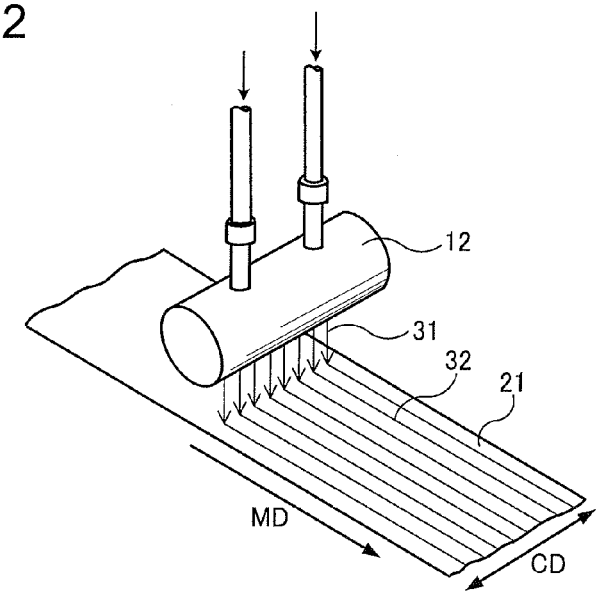
FIG. 2 is a diagram showing an example of a high-pressure water jet stream nozzle.

An example of a high-pressure water jet stream nozzle 12 is shown in FIG. 2. The high-pressure water jet stream nozzle 12 injects a plurality of high-pressure water jet streams 31 arranged in the widthwise direction (CD) of the paper layer 21, in the direction of the paper layer 21. As a result, a plurality of furrows 32, which extend in the machine direction (MD) and are arranged in the widthwise direction of the paper layer 21, are formed on the top surface of the paper layer 21.

Also, when the paper layer 21 receives the high-pressure water jet streams, furrows 32 are formed in the paper layer 21 as mentioned above while the fibers of the paper layer 21 become tangled, thereby increasing the strength of the paper layer 21. The principle by which the fibers of the paper layer 21 become tangled when the paper layer 21 receives the high-pressure water jet streams will now be explained with reference to FIG. 3, although this principle is not restrictive on the invention.

Figure 3:
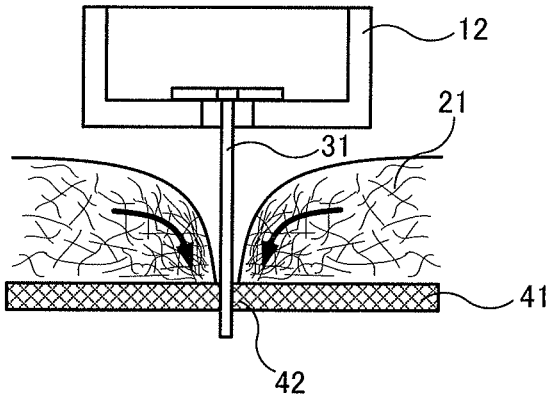
FIG. 3 is a diagram for illustration of the principle by which fibers in a paper layer are tangled by a high-pressure water jet stream.

When the high-pressure water jet stream nozzle 12 injects the high-pressure water jet stream 31 as shown in FIG. 3, the high-pressure water jet stream 31 passes through the paper layer-forming belt 41. This causes the fibers of the paper layer 21 to be drawn inward around the section 42 where the high-pressure water jet stream 31 passes through the paper layer-forming belt 41. As a result, the fibers of the paper layer 21 gather toward the section 42 where the high-pressure water jet stream 31 passes through the paper layer-forming belt 41, thereby causing the fibers to become tangled together.

Tangling of the fibers of the paper layer 21 increases the strength of the paper layer 21, thereby reducing opening of holes, tearing and fly-off even when the paper layer 21 is injected with high-pressure steam in a subsequent step. The wet strength of the paper layer 21 can also be increased without adding a paper strength agent to the paper-making material.

The high-pressure water jet stream energy of the high-pressure water jet streams for injecting of the paper layer 21 with the high-pressure water jet streams is preferably between 0.125 and 1.324 $kW/m^2$. The high-pressure water jet stream energy is calculated by the following formula:

$$\text{High-pressure water jet stream energy}(kW/m^2)=1.63\times\text{injection pressure}(kg/cm^2)\times\text{injection flow rate}(m^2/min)/\text{treatment time}(m/min),$$

wherein, injection pressure ($kg/cm^2$)=750×orifice total open area ($m^2$)×injection pressure ($kg/cm^2$)×0.495.

If the high-pressure water jet stream energy of the high-pressure water jet streams is less than 0.125 $kW/m^2$, the strength of the paper layer 21 may not be significantly increased. Also, if the high-pressure water jet stream energy of the high-pressure water jet streams is greater than 1.324 $kW/m^2$, the paper layer 21 may become too hard, and the bulk of the paper layer 21 may not be significantly increased by the high-pressure steam described below.

The distance between the tip of the high-pressure water jet stream nozzle 12 and the top surface of the paper layer 21 is preferably between 5.0 and 20.0 mm. If the distance between the tip of the high-pressure water jet stream nozzle 12 and the top surface of the paper layer 21 is smaller than 5.0 mm, this may result in problems as the texture of the paper layer will tend to be impaired by the force of the high-pressure water jet streams, and fibers rebounding by the force of the water stream will tend to adhere to the nozzles. Also, if the distance between the tip of the high-pressure water jet stream nozzle 12 and the top surface of the paper layer 21 is greater than 20.0 mm, problems may occur as the treatment efficiency may be notably reduced and the fiber tangling may be weakened.

The hole diameter of the high-pressure water jet stream nozzle 12 is preferably 90 to 150 μm. If the hole diameter of the high-pressure water jet stream nozzle 12 is smaller than 90 μm, a problem may occur as the nozzle may tend to become clogged. If the hole diameter of the high-pressure water jet stream nozzle 12 is larger than 150 μm, a problem may occur as treatment efficiency may be reduced.

The hole pitch of the high-pressure water jet stream nozzle 12 (the distance between the centers of adjacent holes) is preferably 0.5 to 1.0 mm. If the hole pitch of the high-pressure water jet stream nozzle 12 is less than 0.5 mm, problems may occur such as reduced nozzle pressure resistance, and damage. If the hole pitch of the high-pressure water jet stream nozzle 12 is greater than 1.0 mm, the problem of insufficient fiber tangling may result.

Figure 4:
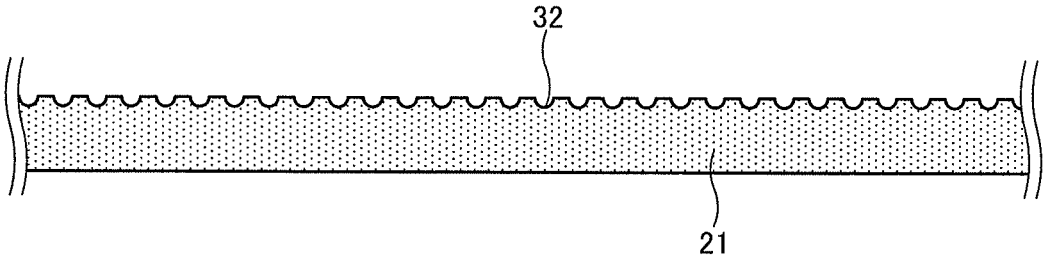
FIG. 4 is a widthwise cross-sectional view of a paper layer that has been injected with a high-pressure water jet stream.

FIG. 4 shows a widthwise cross-section of a paper layer 21 at a location after it has passed between the two high-pressure water jet stream nozzles 12 and the two suction boxes 13 (the location indicated by numeral 22 in FIG. 1). Furrows 32 are formed on the top surface of the paper layer 21 by the high-pressure water jet streams.

The paper layer 21 then passes between two steam nozzles 14 situated above the paper layer-forming belt, and two suction boxes 13, situated at the opposite side of the steam nozzles 14 across the paper layer-forming belt, that sucks steam injected from the steam nozzles 14. At this time, the paper layer 21 is injected with high-pressure steam from the steam nozzles 14, and furrows are formed on the top surface (the surface on the steam nozzle 14 side).

When the paper layer 21 is injected with high-pressure steam, the fibers of the paper layer 21 are loosened and the bulk of the paper layer 21 increases. This causes the paper layer 21 that has been hardened by the high-pressure water jet stream to increase in softness, thereby improving the feel of the paper layer 21. The principle by which the fibers of the paper layer 21 become loosened and the bulk of the paper layer 21 is increased when the paper layer 21 receives the high-pressure steam will now be explained with reference to FIG. 5, although this principle is not restrictive on the invention.

Figure 5:
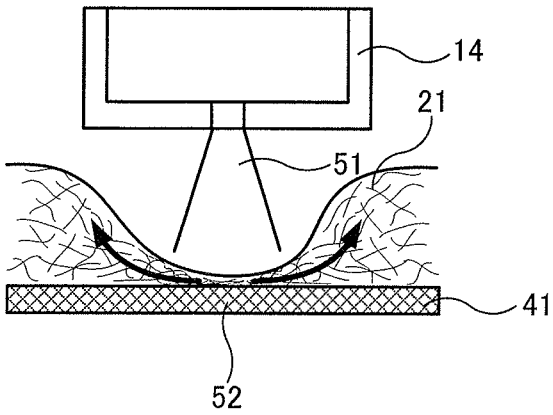
FIG. 5 is a diagram for illustration of the principle by which fibers in a paper layer are loosened and the paper layer bulk is increased by high-pressure steam.

When the steam nozzle 14 injects the high-pressure steam 51 as shown in FIG. 5, the high-pressure steam 51 strikes the paper layer-forming belt 41. Unlike the high-pressure water jet streams 31 injected from the high-pressure water jet stream nozzles 12, most of the high-pressure steam 51 bounces back from the paper layer-forming belt 41. This causes the fibers of the paper layer 21 to become hoisted upward and loosen. The high-pressure steam 51 also causes the fibers of the paper layer 21 to be pushed aside, and the fibers that have been pushed aside move and collect toward the widthwise direction sides from the section 52 where the high-pressure steam 51 strikes the paper layer-forming belt 41, thereby increasing the bulk of the paper layer 21.

Since the strength of the paper layer 21 is increased by the high-pressure water jet stream, there is no need to provide a net on the paper layer 21 to prevent fly-off of the paper layer 21 by the high-pressure steam 51 when the paper layer 21 is injected with the high-pressure steam 51. This increases the treatment efficiency of the paper layer 21 by the high-pressure steam 51. In addition, since there is no need to provide a net, it is possible to reduce maintenance of the nonwoven fabric production apparatus 1 and lower production cost for nonwoven fabrics.

Figure 6:
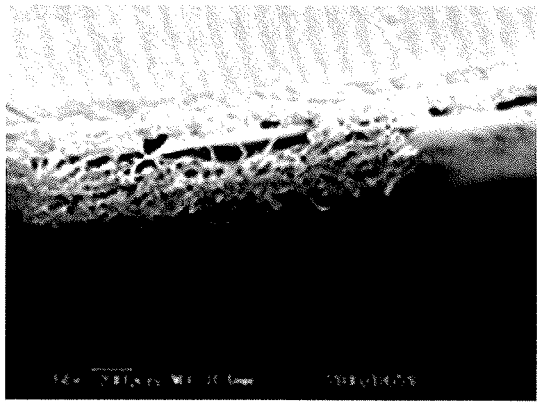
FIG. 6 is a diagram for illustration of changes in paper layer thickness between paper layers before and after injecting of high-pressure steam.
Figure 6:
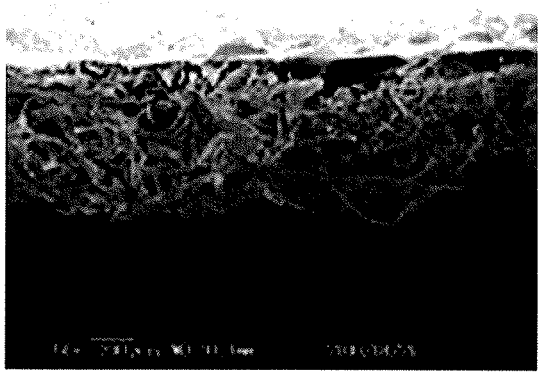

FIG. 6 is a diagram for illustration of changes in paper layer thickness between paper layers before and after injecting of high-pressure steam. FIG. 6(*a*) is a photograph of a cross-section of a paper layer before injecting high-pressure steam, and FIG. 6(*b*) is a photograph of a cross-section of a paper layer after high-pressure steam has been injected. The thickness of the paper layer before injecting the high-pressure steam was 0.30 mm, but upon injecting the high-pressure steam, the thickness of the paper layer increased to 0.57 mm. This indicates that injecting the high-pressure steam increased the bulk of the paper layer and loosened the fibers of the paper layer.

The vapor pressure of the high-pressure steam injected from the steam nozzle 14 is preferably 0.3 to 1.5 MPa. If the vapor pressure of the high-pressure steam is lower than 0.3 MPa, the bulk of the paper layer 21 may not be significantly increased by the high-pressure steam. Also, if the vapor pressure of the high-pressure steam is higher than 1.5 MPa, holes may open in the paper layer 21, the paper layer 21 may undergo tearing, and fly-off may occur.

The suction force with which the paper layer-forming belt attracts the paper layer by the suction boxes 13 that suck the steam injected from the steam nozzles 14 is preferably between −1 and −12 kPa. If the suction force of the paper layer-forming belt is smaller than −1 kPa, problems can potentially occur, as the steam may not be sucked in and may spout upward. If the suction force of the paper layer-forming belt is larger than −12 kPa, the problem of increased drop-off of fibers into the suction area may occur.

The distance between the tip of the steam nozzle 14 and the top surface of the paper layer 21 is preferably between 1.0 and 10 mm. If the distance between the tip of the steam nozzle 14 and the top surface of the paper layer 21 is less than 1.0 mm, problems may occur such as opening of holes in the paper layer 21, or tearing or fly-off of the paper layer 21. Also, if the distance between the tip of the steam nozzle 14 and the top surface of the paper layer 21 is greater than 10 mm, the force of the high-pressure steam that is to form the furrows on the surface of the paper layer 21 will become dispersed, and thereby impairing the efficiency of furrow formation on the surface of the paper layer 21.

Figure 7:
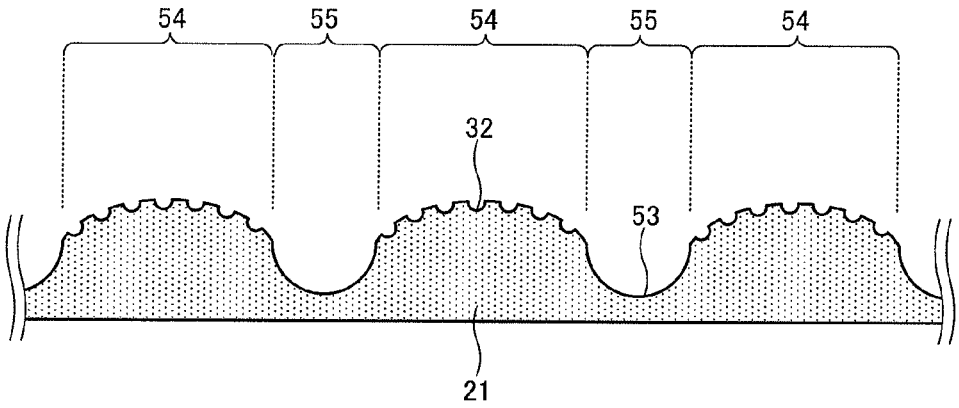
FIG. 7 is a widthwise cross-sectional view of a paper layer that has been injected with high-pressure steam.

The hole diameter of the steam nozzle 14 is preferably larger than the hole diameter of the high-pressure water jet stream nozzle 12, and the hole pitch of the steam nozzle 14 is preferably greater than the hole pitch of the high-pressure water jet stream nozzle 12. This will allow formation of furrows 53 in the paper layer 21 by the high-pressure steam injected from the steam nozzles 14, while leaving the furrows 32 formed by the high-pressure water jet streams injected from the high-pressure water jet stream nozzles 12, as shown in FIG. 7. The region 54 of the paper layer 21 where multiple furrows 32 are present that were formed by the high-pressure water jet streams is a high-strength region of the paper layer 21, and the section 55 in which the furrow 53 was formed by the high-pressure steam is a region where the strength of the paper layer 21 was slightly weakened by the high-pressure steam, compared to the aforementioned region 54. By thus forming high-strength regions and weak regions in the paper layer 21, it is possible to balance the strength of the paper layer 21 with bulk. Also, the bulk of the paper layer 21 is increased and water retention of the paper layer 21 is improved, while the wet strength of the paper layer 21 is also improved. In addition, it is possible to form furrows in the paper layer 21 by the high-pressure steam, while limiting reduction in the strength of the paper layer 21.

The hole diameter of the steam nozzle 14 is preferably 150 to 500 μm. If the hole diameter of the steam nozzle 14 is smaller than 150 μm, problems may occur such as inadequate energy and insufficient pushing aside of the fibers. If the hole diameter of the steam nozzle 14 is larger than 500 μm, problems may occur such as excessive energy and excessively high base material damage.

The hole pitch of the steam nozzle 14 (the distance between the centers of adjacent holes) is preferably 2.0 to 5.0 mm. If the hole pitch of the steam nozzle 14 is less than 2.0 mm, problems may occur such as reduced nozzle pressure resistance, and potential damage. If the hole pitch of the steam nozzle 14 is greater than 5.0 mm, this may result in the problem of a reduced softness-improving effect due to insufficient treatment.

Furrows are formed on the top surface of the paper layer 21 by the high-pressure steam, while irregularities (not shown) are formed on the bottom side of the paper layer 21 (the surface of the paper layer 21 on the paper layer-forming belt 41 side), corresponding to the pattern of the paper layer-forming belt 41. Furrows may also be formed by high-pressure steam on the bottom side of the paper layer.

Next, as shown in FIG. 1, the paper layer 21 is transferred to a paper layer-transporting conveyor 17 by a suction pickup 15. The paper layer 21 is also transferred to a paper layer-transporting conveyor 18 and then to a dryer 19. The dryer 19 is, for example, a yankee dryer, and it causes the paper layer 21 to adhere to a drum heated to about 160° C. by steam, and thereby drying the paper layer 21. The dried paper layer 21 is wound up onto a winder 20 as a nonwoven fabric.

The nonwoven fabric production apparatus used in the method for producing a nonwoven fabric according to the embodiment described above may be modified in the following manner. Components that are identical to the nonwoven fabric production apparatus described above will be denoted by like reference numerals, and the explanation will focus on the sections differing from the aforementioned nonwoven fabric production apparatus.

Modification Example 1 of Nonwoven Fabric Production Apparatus

Figure 8:
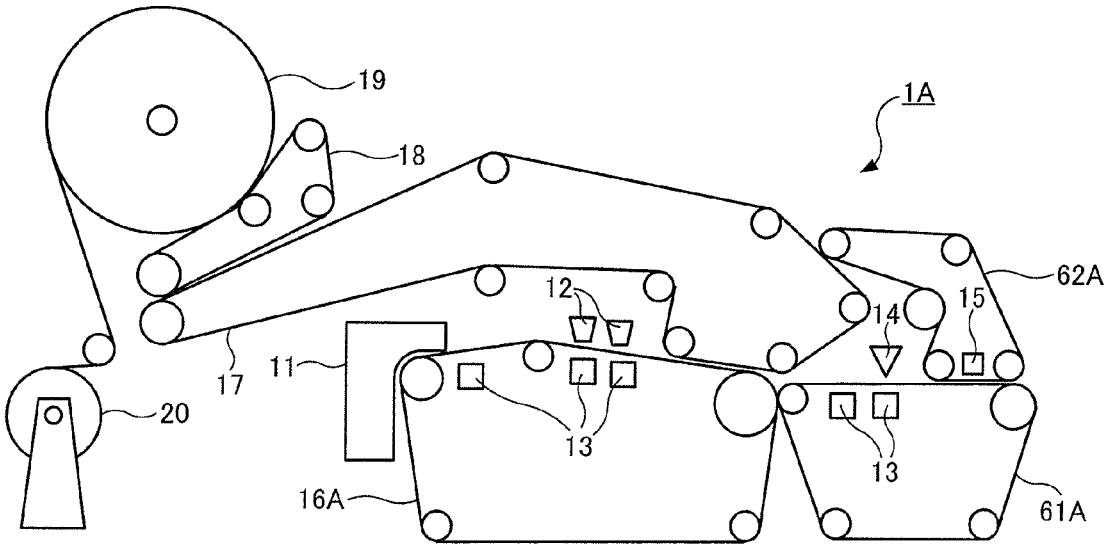
FIG. 8 is a diagram for illustration of a modified example of a nonwoven fabric production apparatus to be used in a method for producing a nonwoven fabric according to an embodiment of the invention.

In the nonwoven fabric production apparatus 1 according to the aforementioned embodiment of the invention, high-pressure steam is injected onto the paper layer on the paper layer-forming conveyor 16. In the nonwoven fabric production apparatus 1A shown in FIG. 8, however, high-pressure steam is not injected on a paper layer-forming conveyor 16A but rather high-pressure steam is injected onto a paper layer on another paper layer-forming conveyor 61A. The paper layer that has been injected with high-pressure steam on the paper layer-transporting conveyor 61A is transferred to a paper layer-transporting conveyor 62A and then transferred to a paper layer-transporting conveyor 17.

Modification Example 2 of Nonwoven Fabric Production Apparatus

Figure 9:
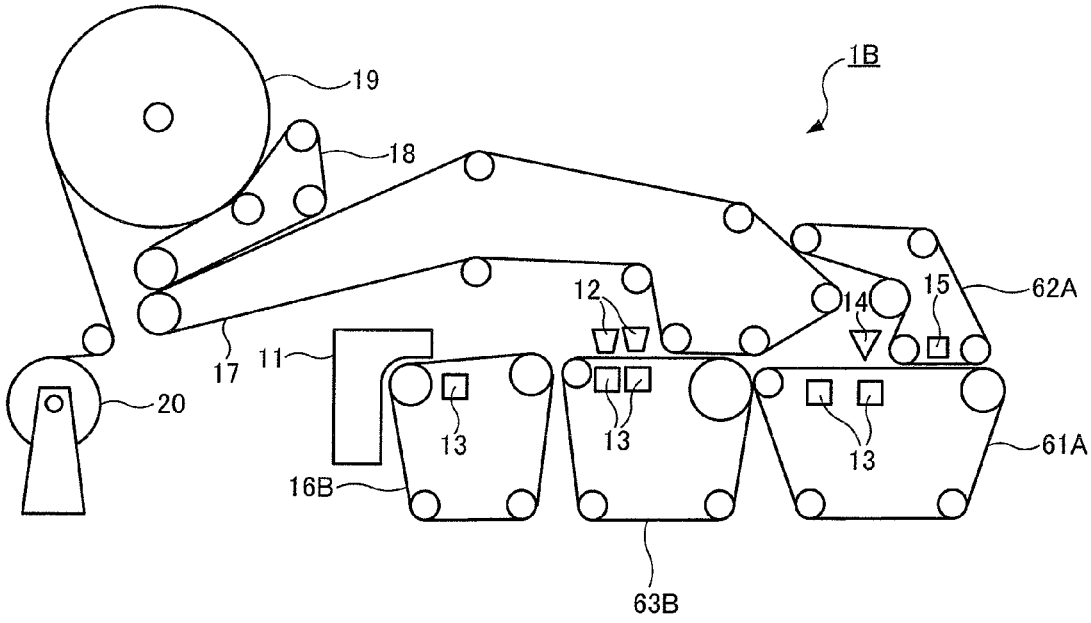
FIG. 9 is a diagram for illustration of a modified example of a nonwoven fabric production apparatus to be used in a method for producing a nonwoven fabric according to an embodiment of the invention.

In the nonwoven fabric production apparatus 1 according to the aforementioned embodiment of the invention, high-pressure water jet streams and high-pressure steam are injected onto the paper layer on the paper layer-forming conveyor 16. In the nonwoven fabric production apparatus 1B shown in FIG. 9, however, high-pressure water jet streams and high-pressure steam are not injected on a paper layer-forming conveyor 16B, but rather high-pressure water jet streams are injected onto the paper layer on a paper layer-forming conveyor 63B while high-pressure steam is injected onto the paper layer on a separate paper layer-forming conveyor 61A. The paper layer that has been injected with high-pressure steam on the paper layer-forming conveyor 61A is transferred to a paper layer-transporting conveyor 62A and then transferred to a paper layer-transporting conveyor 17.

Modification Example 3 of Nonwoven Fabric Production Apparatus

Figure 10:
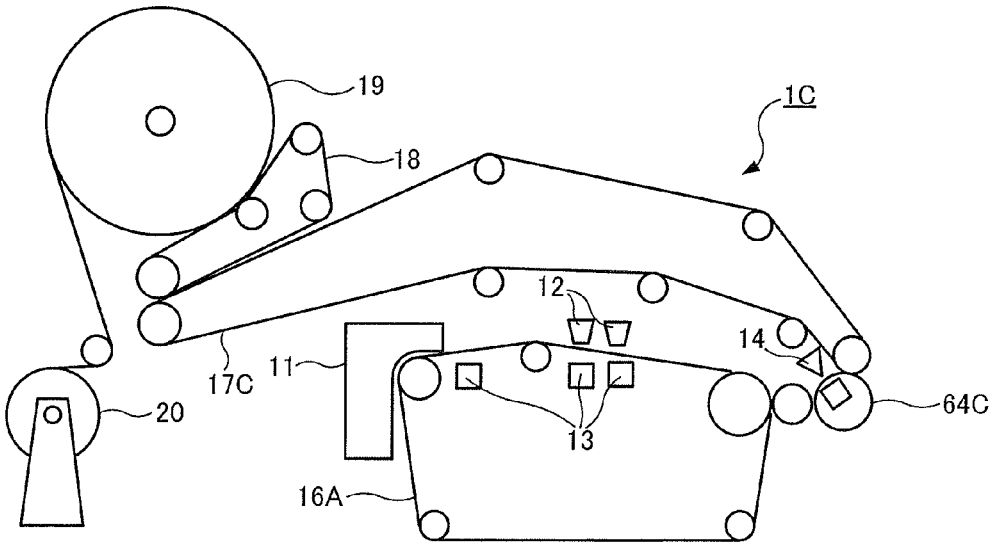
FIG. 10 is a diagram for illustration of a modified example of a nonwoven fabric production apparatus to be used in a method for producing a nonwoven fabric according to an embodiment of the invention.

In the nonwoven fabric production apparatus 1 according to the aforementioned embodiment of the invention, high-pressure steam is injected onto the paper layer on the paper layer-forming conveyor 16. In the nonwoven fabric production apparatus 10 shown in FIG. 10, however, high-pressure steam is not injected on a paper layer-forming conveyor 16A, but rather high-pressure steam is injected onto the paper layer on a suction drum 64C. The paper layer that has been injected with high-pressure steam on the suction drum 64C is transferred to a paper layer-transporting conveyor 17C and then transferred to a paper layer-transporting conveyor 18.

Modification Example 4 of Nonwoven Fabric Production Apparatus

In the nonwoven fabric production apparatus 1 according to the aforementioned embodiment of the invention, high-pressure steam is injected onto the paper layer on the paper layer-forming conveyor 16. In the nonwoven fabric production apparatus 1D shown in FIG. 11, however, high-pressure steam is not injected on a paper layer-forming conveyor 16A, but rather the paper layer is injected with high-pressure steam through the belt of another separate paper layer-transporting conveyor 62D composed of an 18-mesh wire net, on another paper layer-forming conveyor 61A. Also, the paper layer that has been injected with high-pressure steam on the paper layer-forming conveyor 61A is transferred to a paper layer-transporting conveyor 62D and then transferred to a paper layer-transporting conveyor 17.

Modification Example 5 of Nonwoven Fabric Production Apparatus

In the nonwoven fabric production apparatus 1 according to the aforementioned embodiment of the invention, high-pressure steam is injected onto the paper layer on the paper layer-forming conveyor 16. In the nonwoven fabric production apparatus 1E shown in FIG. 12, however, high-pressure steam is not injected on a paper layer-forming conveyor 16A, but rather high-pressure steam is injected onto the paper layer on another paper layer-forming conveyor 61A. Also, the paper layer that has been injected with high-pressure steam on the paper layer-forming conveyor 61A is transferred to a paper layer-transporting conveyor 62A, and then high-pressure steam is injected onto the paper layer on the paper layer-transporting conveyor 62A as well. At this time, the high-pressure steam is injected onto the side opposite the side on which the high-pressure steam has been injected on the paper layer-transporting conveyor 61A. The paper layer that has been transferred to the paper layer-transporting conveyor 62A is transferred to a paper layer-transporting conveyor 17.

Modification Example 6 of Nonwoven Fabric Production Apparatus

Figure 13:
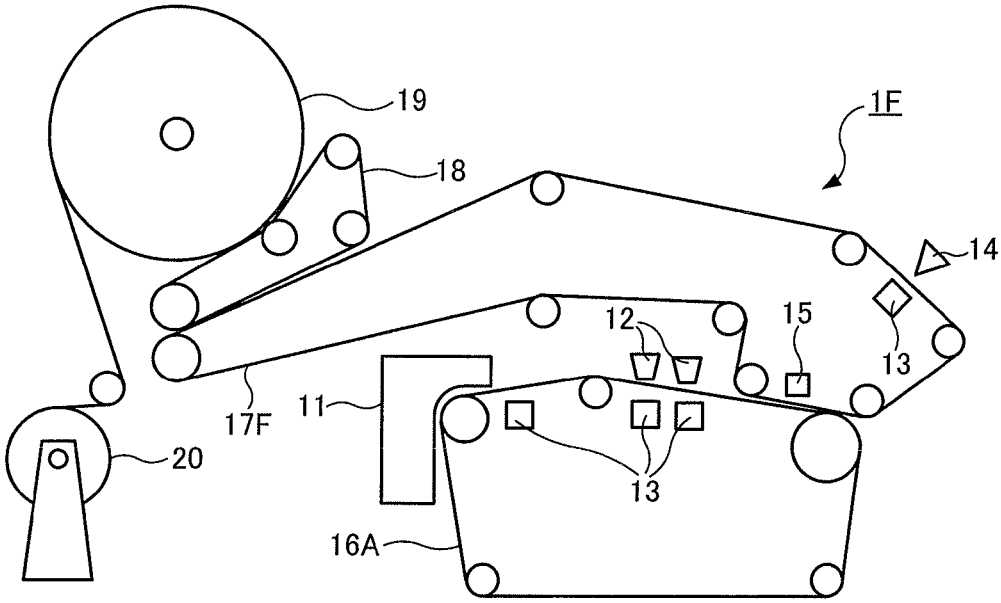
FIG. 13 is a diagram for illustration of a modified example of a nonwoven fabric production apparatus to be used in a method for producing a nonwoven fabric according to an embodiment of the invention.

In the nonwoven fabric production apparatus 1 according to the aforementioned embodiment of the invention, high-pressure steam is injected onto the paper layer on the paper layer-forming conveyor 16. In the nonwoven fabric production apparatus 1F shown in FIG. 13, however, high-pressure steam is not injected on a paper layer-forming conveyor 16A, but rather high-pressure steam is injected onto the paper layer on a paper layer-transporting conveyor 17F employing a wet blanket as the belt. The paper layer that has been injected with high-pressure steam on the paper layer-transporting conveyor 17F is transferred to a paper layer-transporting conveyor 18.

Modification Example 7 of Nonwoven Fabric Production Apparatus

In the nonwoven fabric production apparatus 1 according to the aforementioned embodiment of the invention, high-pressure steam is injected onto the paper layer on the paper layer-forming conveyor 16. In the nonwoven fabric production apparatus 1G shown in FIG. 14, however, high-pressure steam is not injected on a paper layer-forming conveyor 16A, but rather high-pressure steam is injected onto the paper layer on a paper layer-transporting conveyor 18G employing a top blanket as the belt. The paper layer that has been injected with high-pressure steam on the paper layer-transporting conveyor 18G is transferred to dryer 19.

Modification Example 8 of Nonwoven Fabric Production Apparatus

With the nonwoven fabric production apparatus 1 according to the aforementioned embodiment of the invention and nonwoven fabric production apparatuses 1A to 1G as modified examples 1 to 7, the high-pressure water jet stream nozzles and steam nozzles may be oscillated in the cross-machine direction to form wavy furrows on the surface of the paper layer. Also, the oscillation of the steam nozzles in the cross-machine direction may be at high speed, to inject the high-pressure steam over the entire paper layer without forming grooves in the surface of the paper layer.

The aforementioned embodiment may be combined with any one or more of the modifications. Any two or more modifications may be combined with each other.

The explanation above is merely an example, and the invention is in no way restricted by the described embodiment.

EXAMPLES

The present invention will now be explained in greater detail by examples, with the understanding that these examples are in no way limitative on the invention.

For the examples and reference examples, the pre-pressing dry thickness, the post-pressing dry thickness, the post-pressing dry density, the dry tensile strength, the dry tensile elongation, the wet tensile strength and the wet tensile elongation were measured in the following manner.

(Pre-Pressing Dry Thickness)

The paper layer that had been injected with the high-pressure water jet streams and high-pressure steam was dried with a yankee dryer at 160° C. to prepare a test sample. A thickness gauge (Model FS-60DS by Daiei Kagaku Seiki Mfg. Co., Ltd.) equipped with a 15 $cm^2$ stylus was used to measure the thickness of the test sample under measuring conditions with a measuring load of 3 $g/cm^2$. The thickness was measured at three locations for each test sample, and the average value of the three thicknesses was recorded as the pre-pressing dry thickness.

(Post-Pressing Dry Thickness)

The paper layer that had been injected with the high-pressure water jet streams and high-pressure steam was dewatered to adjust the water content in the paper layer to 80% to 70%, using a press roll under pressing conditions with a pressure of 3 $kg/cm^2$, and dried with a yankee dryer at 160° C. to prepare a test sample. A thickness gauge (Model FS-60DS by Daiei Kagaku Seiki Mfg. Co., Ltd.) equipped with a 15 $cm^2$ stylus was used to measure the thickness of the test sample under measuring conditions with a measuring load of 3 $g/cm^2$. The thickness was measured at three locations for each measuring sample, and the average value of the three thicknesses was recorded as the post-pressing dry thickness.

(Post-Pressing Dry Bulk Density)

The post-pressing dry bulk density was calculated from the paper layer basis weight and the dry thickness of the paper layer after the aforementioned pressing. The dry thickness of the paper layer after pressing was measured in the following manner. The pressed paper layer was impregnated with liquid nitrogen and frozen, after which it was cut with a razor and returned to ordinary temperature, and then an electron microscope (for example, a VE7800 by Keyence Corp.) was used to measure the thickness of the pressed paper layer at a magnification of 50×. The reason for freezing the absorbent article is to prevent variation in the thickness by the compression during cutting with the razor. The basis weight of the absorbent body before pressing was divided by the thickness, to calculate the density.

(Dry Tensile Strength)

The non-pressed paper layer that had been injected with the high-pressure water jet streams and high-pressure steam was dried with a yankee dryer at 160° C. A 25 mm-wide paper layer strip having the lengthwise direction in the machine direction of the paper layer and a 25 mm-wide paper layer strip having the lengthwise direction in the cross-machine direction of the paper layer were cut out from the dried paper layer, to prepare test samples. Three test samples for measuring the dry tensile strength in the machine direction and three test samples for measuring the dry tensile strength in the cross-machine direction were used to measure the tensile strengths in the machine direction and in the cross-machine direction, using a tensile tester equipped with a load cell with a maximum load capacity of 50N (AGS-1kNG Autograph, product of Shimadzu Corp.), under conditions with a clamp distance of 100 mm and a pull rate of 100 mm/min. The average value of the tensile strengths of the three test samples for measuring the dry tensile strength in the machine direction, and the average value of the tensile strengths of the three test samples for measuring the dry tensile strength in the cross-machine direction were recorded as the dry tensile strengths in the machine direction in the cross-machine direction, respectively.

(Dry Tensile Elongation)

The non-pressed paper layer that had been injected with the high-pressure water jet streams and high-pressure steam was dried with a yankee dryer at 160° C. A 25 mm-wide paper layer strip having the lengthwise direction in the machine direction of the paper layer and a 25 mm-wide paper layer strip having the lengthwise direction in the cross-machine direction of the paper layer were cut out from the dried paper layer, to prepare test samples. Three test samples for measuring the dry tensile elongation in the machine direction and three test samples for measuring the dry tensile elongation in the cross-machine direction were used to measure the tensile elongations in the machine direction and in the cross-machine direction, using a tensile tester equipped with a load cell with a maximum load capacity of 50N (AGS-1kNG Autograph, product of Shimadzu Corp.), under conditions with a clamp distance of 100 mm and a pull rate of 100 mm/min. The tensile elongation is calculated by dividing the maximum elongation (mm) when the test sample has been stretched by a tensile tester, by the clamp distance (100 mm). The average value of the tensile elongations of the three test samples for measuring the dry tensile elongation in the machine direction, and the average value of the tensile elongations of the three test samples for measuring the dry tensile elongation in the cross-machine direction were recorded as the dry tensile elongations in the machine direction and in the cross-machine direction, respectively.

(Wet Tensile Strength)

After the non-pressed paper layer that had been injected with the high-pressure water jet streams and high-pressure steam was dried with a yankee dryer at 160° C., a 25 mm-wide paper layer strip having the lengthwise direction in the machine direction of the paper layer and a 25 mm-wide paper layer strip having the lengthwise direction in the cross-machine direction of the paper layer, were cut out from the paper layer, to prepare test samples, and each of the test samples was impregnated with water in an amount of 2.5 times the weight thereof (water content: 250%). Three test samples for measuring the wet tensile strength in the machine direction and three test samples for measuring the wet tensile strength in the cross-machine direction were used to measure the tensile strengths in the machine direction and in the cross-machine direction, using a tensile tester equipped with a load cell with a maximum load capacity of 50N (AGS-1kNG Autograph, product of Shimadzu Corp.), under conditions with a clamp distance of 100 mm and a pull rate of 100 mm/min. The average value of the tensile strengths of the three test samples for measuring the wet tensile strength in the machine direction, and the average value of the tensile strengths of the three test samples for measuring the wet tensile strength in the cross-machine direction were recorded as the wet tensile strengths in the machine direction in the cross-machine direction, respectively.

(Wet Tensile Elongation)

After the non-pressed paper layer that had been injected with the high-pressure water jet streams and high-pressure steam was dried with a yankee dryer at 160° C., a 25 mm-wide paper layer strip having the lengthwise direction in the machine direction of the paper layer and a 25 mm-wide paper layer strip having the lengthwise direction in the cross-machine direction of the paper layer, were cut out from the paper layer, to prepare test samples, and each of the test samples was impregnated with water in an amount of 2.5 times the weight thereof (water content: 250%). Three test samples for measuring the wet tensile elongation in the machine direction and three test samples for measuring the wet tensile elongation in the cross-machine direction were used to measure the tensile elongations in the machine direction and in the cross-machine direction, using a tensile tester equipped with a load cell with a maximum load capacity of 50N (AGS-1kNG Autograph, product of Shimadzu Corp.), under conditions with a clamp distance of 100 mm and a pull rate of 100 ram/min. The average value of the tensile elongations of the three test samples for measuring the wet tensile elongation in the machine direction, and the average value of the tensile elongations of the three test samples for measuring the wet tensile elongation in the cross-machine direction were recorded as the wet tensile elongations in the machine direction and in the cross-machine direction, respectively.

The production methods used in the examples and comparative examples will now be explained.

Example 1

Example 1 was carried out using a nonwoven fabric production apparatus 1 according to the embodiment of the invention. A paper-making material was prepared containing 70 mass % Northern bleached Kraft pulp (NBKP) and 30 mass % rayon (Corona, product of Daiwabo Rayon Co., Ltd.), having a size of 1.1 dtex and a fiber length of 7 mm. Then, a starting material head was used to supply paper-making material onto a paper layer-forming belt (OS80, by Nippon Filcon Co., Ltd.), and a suction box was used for dewatering of the paper-making material to form a paper layer. The water content of the paper layer was 80%. The "water content" is the amount of water contained in the paper layer, where the weight of the paper layer is defined as 100%. Next, two high-pressure water jet stream nozzles were used to inject high-pressure water jet streams onto the paper layer. During this time the high-pressure water jet stream energy per high-pressure water jet stream nozzle was 0.23 kW/m$^2$, and since two high-pressure water jet stream nozzles were used to inject high-pressure water jet streams onto the paper layer, the high-pressure water jet stream energy of the high-pressure water jet streams injected onto the paper layer was 0.46 kW/m$^2$. The distance between the tip of the high-pressure water jet stream nozzle and the top surface of the paper layer was 10 mm. Also, the hole diameter of each high-pressure water jet stream nozzle was 92 μm and the hole pitch was 0.5 mm. Next, two steam nozzles were used to inject high-pressure steam onto the paper layer. The vapor pressure of the high-pressure steam was 0.7 MPa. The distance between the tip of the steam nozzles and the top surface of the paper layer was 2 mm. Also, the hole diameter of each steam nozzle was 300 μm and the hole pitch was 2.0 mm. The suction force with which the paper layer-forming belt attracted the paper layer by the suction boxes sucking the steam injected from the steam nozzles was −1 kPa. After being transferred to the two paper layer-transporting conveyors, the paper layer was transferred to a yankee dryer that had been heated to 160° C., and dried. The dried paper layer was used as Example 1. The paper-making speed for production of Example 1 was 70 m/min, and the basis weight of Example 1 was approximately 50 g/m$^2$.

Example 2

Example 2 was produced by the same method as the method for producing Example 1, except that the high-pressure water jet stream energy was 0.125 kW/m$^2$.

Example 3

Example 3 was produced by the same method as the method for producing Example 1, except that the high-pressure water jet stream energy was 1.324 kW/m$^2$.

Example 4

Example 4 was produced by the same method as the method for producing Example 1, except that the vapor pressure of the high-pressure steam was 0.3 MPa.

Example 5

Figure 12:
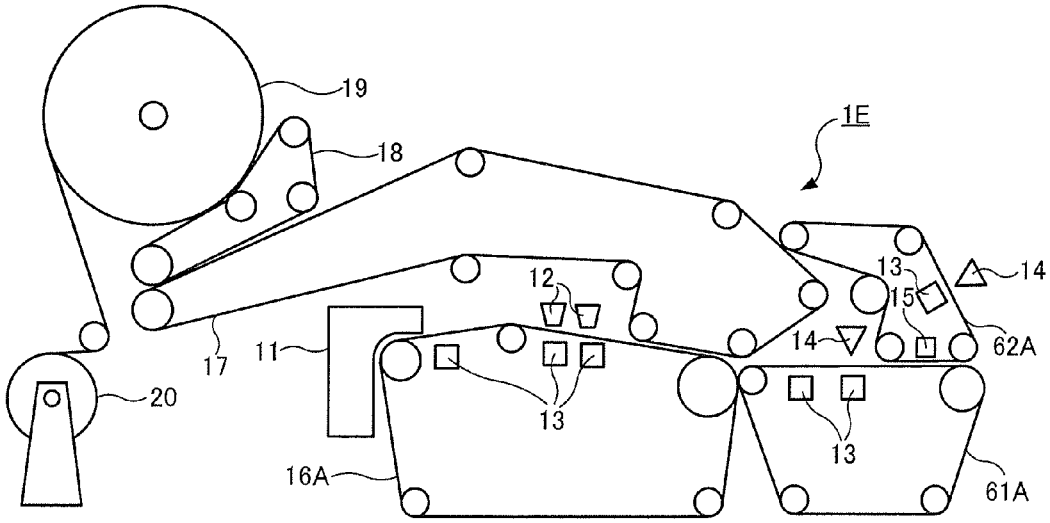
FIG. 12 is a diagram for illustration of a modified example of a nonwoven fabric production apparatus to be used in a method for producing a nonwoven fabric according to an embodiment of the invention.

Example 5 was produced by the same method as the method for producing Example 1, except that it was produced using the nonwoven fabric production apparatus 1E shown in FIG. 12. Example 5 had furrows formed by high-pressure steam injected from a steam nozzle on one side and furrows formed by high-pressure steam injected from a steam nozzle on the other side.

Example 6

Figure 11:
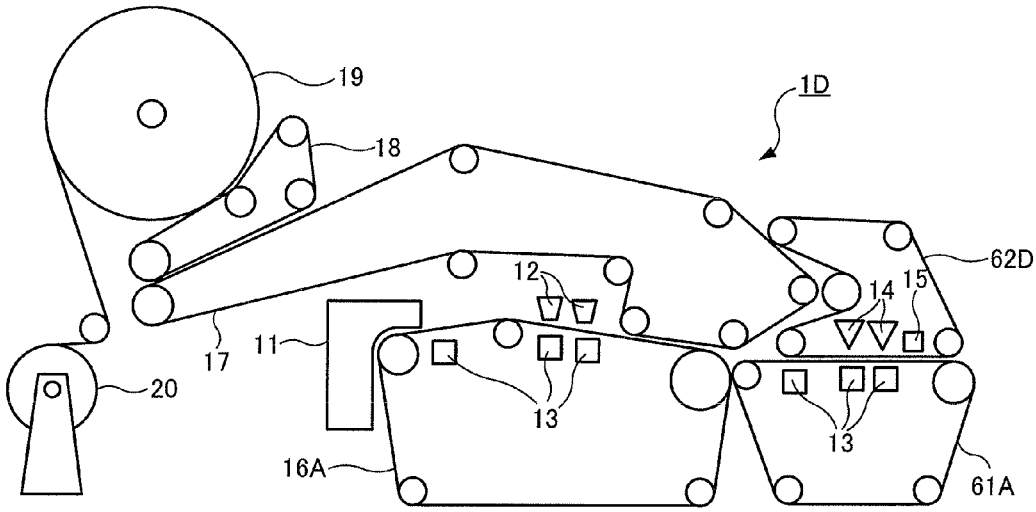
FIG. 11 is a diagram for illustration of a modified example of a nonwoven fabric production apparatus to be used in a method for producing a nonwoven fabric according to an embodiment of the invention.

Example 6 was produced by the same method as the method for producing Example 1, except that it was produced using the nonwoven fabric production apparatus 1D shown in FIG. 11. Example 6 had furrows formed by injecting the paper layer with high-pressure steam through an 18-mesh wire.

Example 7

Example 7 was produced by the same method as the method for producing Example 1, except that only one steam nozzle was used.

Example 8

Example 8 was produced by the same method as the method for producing Example 1, except that the hole diameter of the steam nozzles was 500 μm.

Example 9

Example 9 was produced by the same method as the method for producing Example 1, except that the distance between the tip of the steam nozzle and the top surface of the paper layer was 10 mm.

Example 10

Example 10 was produced by the same method as the method for producing Example 1, except that a 5-mesh pattern wire formed of aramid fibers was used as the paper layer-forming belt of the paper layer-forming conveyor.

Example 11

Figure 14:
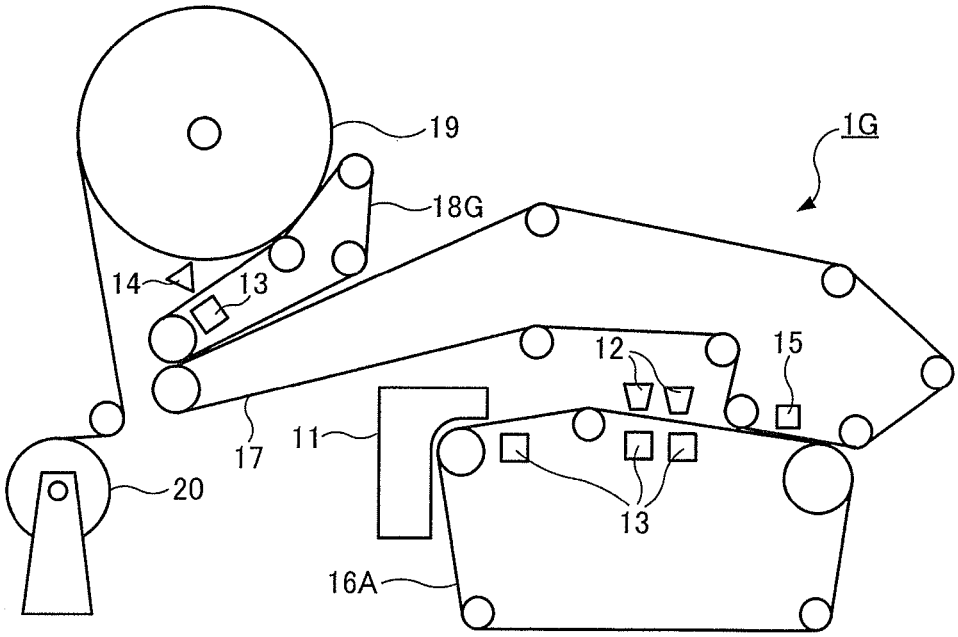
FIG. 14 is a diagram for illustration of a modified example of a nonwoven fabric production apparatus to be used in a method for producing a nonwoven fabric according to an embodiment of the invention.

Example 11 was produced by the same method as the method for producing Example 1, except that it was produced using the nonwoven fabric production apparatus 1G shown in FIG. 14. For production of Example 11, a blanket was used as the belt on the bottom side of the paper layer during injecting of the high-pressure steam.

Example 12

Example 12 was produced by the same method as the method for producing Example 1, except that the high-pressure water jet stream energy was 0.0682 kW/m$^2$.

Example 13

Example 13 was produced by the same method as the method for producing Example 1, except that the high-pressure water jet stream energy was 1.739 kW/m$^2$.

Example 14

Example 14 was produced by the same method as the method for producing Example 1, except that the distance between the tip of the steam nozzle and the top surface of the paper layer was 12 mm.

Example 15

Example 15 was produced by the same method as the method for producing Example 1, except that the vapor pressure of the high-pressure steam was 0.2 MPa.

Comparative Example 1

Comparative Example 1 was produced by the same method as the method for producing Example 1, except that high-pressure steam was not injected onto the paper layer.

Comparative Example 2

Comparative Example 2 was produced by the same method as the method for producing Example 1, except that a paper-making material containing beaten NBKP and 0.6 mass % of a paper strength agent with respect to the weight of the beaten NBKP was used, no high-pressure water jet stream was injected onto the paper layer, the suction box pressure was −7.5 kPa, a mesh belt was situated between the paper layer and the steam nozzles, and the distance between the tip of the steam nozzle and the top surface of the paper layer was 20 mm.

The production conditions for the examples and comparative examples are shown in Table 1.

TABLE 1

Production conditions for examples and comparative examples

| | Paper-making material | | High-pressure water jet | | | | | | | | | | | |
|---|---|---|---|---|---|---|---|---|---|---|---|---|---|---|
| | NBKP CSF 700 cc | Rayon 1.1 dtex × 7 mm | stream energy (kW/m$^2$) | Steam pressure (MPa) | Steam nozzle temperature (° C.) | Steam nozzle hole diameter (μm) | Steam nozzle hole pitch (mm) | Number of steam nozzles | Distance between steam nozzle and paper layer (mm) | Paper layer-forming belt pressure (kPa) | Paper layer-forming belt mesh | Paper layer water content before steam injecting | Mesh belt on steam nozzle side | Location of steam injecting |
| Example 1 | 70% | 30% | 0.46 | 0.7 | 175 | 300 | 2 | 2 | 2 | −1.0 | 18 | 80% | — | Paper layer-forming wire |
| Example 2 | 70% | 30% | 0.125 | 0.7 | 175 | 300 | 2 | 2 | 2 | −1.0 | 18 | 80% | — | Paper layer-forming wire |
| Example 3 | 70% | 30% | 1.324 | 0.7 | 175 | 300 | 2 | 2 | 2 | −1.0 | 18 | 80% | — | Paper layer-forming wire |
| Example 4 | 70% | 30% | 0.46 | 0.3 | 120 | 300 | 2 | 2 | 2 | −1.0 | 18 | 80% | — | Paper layer-forming wire |
| Example 5 | 70% | 30% | 0.46 | 0.7 | 175 | 300 | 2 | 1 above 1 below | 2 | −1.0 | 18 | 80% | — | Paper layer-forming wire |
| Example 6 | 70% | 30% | 0.46 | 0.7 | 175 | 300 | 2 | 2 | 2 | −1.0 | 18 | 80% | 18 mesh | Paper layer-forming wire |
| Example 7 | 70% | 30% | 0.46 | 0.7 | 175 | 300 | 2 | 1 | 2 | −1.0 | 18 | 80% | — | Paper layer-forming wire |

TABLE 1-continued

Production conditions for examples and comparative examples

| | Paper-making material | | High-pressure water jet | | Steam | Steam nozzle | Steam | Number | Distance between steam nozzle | Paper layer- | Paper layer- | Paper layer water | Mesh | |
|---|---|---|---|---|---|---|---|---|---|---|---|---|---|---|
| | NBKP CSF 700 cc | Rayon 1.1 dtex × 7 mm | stream energy (kW/m$^2$) | Steam pressure (MPa) | nozzle temperature (° C.) | hole diameter (μm) | nozzle hole pitch (mm) | of steam nozzles | and paper layer (mm) | forming belt pressure (kPa) | forming belt mesh | content before steam injecting | belt on steam nozzle side | Location of steam injecting |
| Example 8 | 70% | 30% | 0.46 | 0.5 | 140 | 500 | 2 | 2 | 2 | −1.0 | 18 | 80% | — | Paper layer-forming wire |
| Example 9 | 70% | 30% | 0.46 | 0.7 | 175 | 300 | 2 | 2 | 10 | −1.0 | 18 | 80% | — | Paper layer-forming wire |
| Example 10 | 70% | 30% | 0.46 | 0.7 | 175 | 300 | 2 | 2 | 2 | −1.0 | 18 | 80% | — | Pattern wire |
| Example 11 | 70% | 30% | 0.46 | 0.7 | 175 | 300 | 2 | 2 | 2 | −1.0 | 18 | 80% | — | TOP blanket |
| Example 12 | 70% | 30% | 0.0682 | 0.7 | 175 | 300 | 2 | 2 | 2 | −1.0 | 18 | 70% | — | Paper layer-forming wire |
| Example 13 | 70% | 30% | 1.739 | 0.7 | 175 | 300 | 2 | 2 | 2 | −1.0 | 18 | 80% | — | Paper layer-forming wire |
| Example 14 | 70% | 30% | 0.46 | 0.7 | 175 | 300 | 2 | 2 | 12 | −1.0 | 18 | 80% | — | Paper layer-forming wire |
| Example 15 | 70% | 30% | 0.46 | 0.2 | 110 | 300 | 2 | 2 | 2 | −1.0 | 18 | 80% | — | Paper layer-forming wire |
| Comparative Example 1 | 70% | 30% | — | 0.7 | 175 | 300 | 2 | 2 | 2 | −1.0 | 18 | 80% | — | Paper layer-forming wire |
| Comparative Example 2 | 100% | — | — | 0.7 | 175 | 300 | 2 | 1 | 20 | −7.5 | 5 | 75% | 18 mesh | Pattern wire |

The pre-pressing dry thicknesses, post-pressing dry thicknesses, pressed dry bulk densities, dry tensile strengths, drytensile elongations, wet tensile strengths and wet tensile elongations for the examples and comparative examples are shown in Table 2.

TABLE 2

Pre-pressing dry thickness, post-pressing dry thickness, post-pressing bulk density, dry tensile strength, dry tensile elongation, wet tensile strength and wet tensile elongation for examples and comparative examples

| | Paper layer basis weight | Pre-pressing dry thickness | Post-pressing dry thickness | Post-pressing bulk density | Dry tensile strength (N/25 mm) | | Dry tensile elongation (%) | | Wet tensile strength (N/25 mm) | | Wet tensile elongation (%) | |
|---|---|---|---|---|---|---|---|---|---|---|---|---|
| | (g/m$^2$) | (mm) | (mm) | (g/cm$^3$) | MD | CD | MD | CD | MD | CD | MD | CD |
| Example 1 | 50.4 | 0.92 | 0.55 | 0.09 | 8.8 | 4.4 | 6.6 | 20.0 | 2.9 | 2.0 | 24.8 | 40.0 |
| Example 2 | 49.9 | 1.11 | 0.67 | 0.07 | 5.2 | 2.1 | 5.1 | 9.9 | 1.0 | 0.8 | 18.9 | 25.1 |
| Example 3 | 49.0 | 0.76 | 0.49 | 0.10 | 9.5 | 4.5 | 9.8 | 21.5 | 3.5 | 2.6 | 26.3 | 42.9 |
| Example 4 | 49.9 | 0.53 | 0.48 | 0.10 | 10.9 | 3.8 | 6.9 | 13.6 | 3.2 | 2.2 | 33.5 | 53.6 |
| Example 5 | 49.7 | 1.01 | 0.61 | 0.08 | 6.8 | 4.4 | 9.4 | 20.7 | 3.4 | 2.0 | 26.8 | 44.2 |
| Example 6 | 50.1 | 0.81 | 0.49 | 0.10 | 9.1 | 4.6 | 8.2 | 20.1 | 3.3 | 2.3 | 34.1 | 50.5 |
| Example 7 | 49.8 | 0.86 | 0.52 | 0.10 | 9.6 | 4.8 | 7.9 | 21.1 | 3.1 | 1.9 | 26.9 | 42.2 |
| Example 8 | 51.2 | 1.08 | 0.65 | 0.08 | 6.1 | 3.1 | 16.1 | 14.3 | 2.5 | 1.5 | 38.6 | 29.7 |
| Example 9 | 50.5 | 0.48 | 0.49 | 0.10 | 6.2 | 5.3 | 6.8 | 19.7 | 3.8 | 2.1 | 27.1 | 43.6 |
| Example 10 | 51.7 | 0.95 | 0.57 | 0.09 | 7.2 | 3.9 | 8.3 | 19.7 | 2.7 | 1.7 | 25.0 | 38.4 |
| Example 11 | 51.6 | 0.74 | 0.66 | 0.08 | 5.2 | 4.6 | 7.7 | 20.7 | 2.6 | 1.6 | 28.5 | 28.3 |
| Example 12 | 50.1 | 1.13 | 0.68 | 0.07 | 5.0 | 1.8 | 4.2 | 8.3 | too weak | too weak | too weak | too weak |
| Example 13 | 51.1 | 0.48 | 0.39 | 0.13 | 10.2 | 4.9 | 11.1 | 24.3 | 4.1 | 3.2 | 29.7 | 49.3 |
| Example 14 | 51.1 | 0.39 | 0.36 | 0.14 | 12.5 | 4.7 | 6.1 | 15.5 | 3.0 | 2.0 | 28.7 | 52.3 |
| Example 15 | 49.7 | 0.40 | 0.36 | 0.14 | 11.6 | 4.1 | 6.7 | 14.1 | 3.1 | 2.2 | 29.1 | 50.2 |
| Comparative Example 1 | x | x | x | x | x | x | x | x | x | x | x | x |
| Comparative Example 2 | 22 | 1.24 | 0.33 | 0.07 | 2.3 | 1.7 | 3.8 | 2.1 | too weak | too weak | too weak | too weak |

Comparative Example 1 could not be produced, as the paper layer disintegrated by fly-off when the high-pressure steam was injected onto the paper layer. Comparative Example 2 had very weak paper layer strength in a wet state, and therefore the wet tensile strength and wet tensile elongation of Comparative Example 2 could not be measured.

Examples 1 to 11 had high strength, high bulk and softness. Comparative Example 2 was not bulky, had weak strength, and lacked softness.

Comparative Example 1 wherein no high-pressure water jet stream was injected, could not be produced as the strength of the paper layer was weaker than the force of the high-pressure steam when the high-pressure steam was injected onto the paper layer, resulting in disintegration of the paper layer by fly-off. On the other hand, in none of Examples 1 to 11 did the paper layer disintegrate by fly-off when the high-pressure steam was injected onto the paper layer, and all could be produced. This indicated that injecting a high-pressure water jet stream onto the paper layer before injecting high-pressure steam onto the paper layer can impart strength that allows the paper layer to withstand injecting of high-pressure steam.

Comparative Example 2 had increased nonwoven fabric strength due to addition of the paper strength agent instead of high-pressure water jet stream injecting. However, the strength of Comparative Example 2 in the dry state was weak, and the strength of the nonwoven fabric in the wet state was too weak for measurement of the wet tensile strength and wet tensile elongation. On the other hand, Examples 1 to 11 had high strength, high bulk and softness. This indicated that treatment by injecting high-pressure water jet streams onto the paper layer can increase the strength of a nonwoven fabric in the dry state and wet state, more than addition of a paper strength agent.

With Example 12, the strength of the paper layer was not increased even by treatment with high-pressure water jet streams. With Example 13, the strength of the paper layer was excessively increased by treatment with high-pressure water jet streams, and therefore the fibers of the paper layer could not be loosened by treatment with high-pressure steam. Therefore, the bulk did not increase and the bulk density was higher. On the other hand, Examples 1 to 3 had high strength, high bulk and softness. This indicated that it is preferred for the high-pressure water jet stream energy of high-pressure water jet streams injected onto the paper layer to be between 0.125 and 1.324 kW/m$^2$.

With Example 14, the distance between the tip of the steam nozzle and the top surface of the paper layer was too large, and therefore the high-pressure steam energy applied to the paper layer was reduced, the bulk of the paper layer was not increased, and the bulk density was high. On the other hand, Examples 1 and 9 had high strength, high bulk and softness. This indicated that it is preferred for the distance between the tip of the steam nozzle and the top surface of the paper layer to be not greater than 10 mm.

With Example 15, the high-pressure steam vapor pressure was too weak, and the bulk was not increased. On the other hand, Examples 1 and 4 had high strength, high bulk and softness. This indicated that it is preferred for the vapor pressure of the high-pressure steam injected onto the paper layer to be at least 0.3 MPa.

Examples 1 to 11 all had post-pressing bulk densities of not greater than 0.10 g/cm$^3$. Also, Examples 1 to 11 all had post-pressing dry thicknesses of 0.45 mm or greater, and high bulk. On the other hand, Comparative Example 1 had a post-pressing bulk density of greater than 0.10 g/cm$^3$, and the post-pressing dry thickness was smaller than 0.45 mm.

The post-pressing dry thickness for Example 1 was 0.55 mm. The post-pressing dry thickness of a sample produced by the same method as Example 1, except for omitting injecting with high-pressure steam, was 0.36 mm. This indicated that injecting high-pressure steam can increase the bulk of a nonwoven fabric by a factor of 1.5. Also, the density of Example 1 was a small value of 0.09 g/cm$^3$. Thus, it was possible to obtain a bulky and low-density nonwoven fabric in Example 1.

With Example 10, it was possible to produce a bulky and low-density nonwoven fabric using 5-mesh pattern wire formed of aramid fibers as the belt on the bottom side of the paper layer during injecting of the high-pressure steam. Also, with Example 11, it was possible to produce a bulky and low-density nonwoven fabric using a blanket as the belt on the bottom side of the paper layer during injecting of the high-pressure steam. This indicated that any support that is air-permeable can be used as the belt on the bottom side of the paper layer during injecting of high-pressure steam. Also, for Example 11, the high-pressure steam was injected onto the paper layer just before drying the paper layer with the dryer 19. This indicated that it is possible to treat the paper layer with high-pressure steam at any point from the paper-making step to the drying step.

EXPLANATION OF SYMBOLS

1, 1A-1G Nonwoven fabric production apparatuses
11 Starting material supply head
12 High-pressure water jet stream nozzle
13 Suction box
14 Steam nozzle
15 Suction pickup
16, 16A, 16B, 61A, 63B Paper layer-forming conveyors
17, 17C, 17F, 18, 18G, 62A, 62D Paper layer-transporting conveyors
19 Dryer
20 Winder
21 Paper layer
31 High-pressure water jet stream
32 Furrow
41 Paper layer-forming belt
51 High-pressure steam
53 Furrow
64C Suction drum

The invention claimed is:

1. A method of producing a nonwoven fabric, said method comprising:

(a) a step of supplying a water-containing paper-making material onto a support to form a paper layer on the support, wherein the water-containing paper-making material is in a form of a fiber suspension, (b) a step of injecting a pressurized water jet stream onto the paper layer from a pressurized water jet stream nozzle provided above the support, (c) a step of injecting pressurized steam onto the paper layer, on which the pressurized water jet stream has been injected, from a steam nozzle provided above the support, and (d) a step of drying the paper layer on which the pressurized steam has been injected.

2. The method according to claim 1, wherein a hole diameter of the steam nozzle is larger than a hole diameter of the pressurized water jet stream nozzle, and a hole pitch of the steam nozzle is greater than a hole pitch of the pressurized water jet stream nozzle.

3. The method according to claim 1, wherein the pressurized water jet stream energy during the step of injecting the pressurized water jet stream onto the paper layer is between 0.125 and 1.324 $kW/m^2$, a pressure of the pressurized steam in the step of injecting the pressurized steam onto the paper layer is 0.3 Mpa or greater, and a distance between a tip of the steam nozzle and a top surface of the paper layer in the step of injecting the pressurized steam onto the paper layer is not greater than 10 mm.

4. The method according to claim 1, wherein in step (b), the pressurized water jet stream injected onto the paper layer forms first furrows on the paper layer, and in step (c), the pressurized steam injected onto the paper layer forms second furrows on the paper layer.

5. The method according to claim 4, wherein a depth of the second furrows is greater than a depth of the first furrows.

* * * * *